US006964559B2

(12) United States Patent
Behling et al.

(10) Patent No.: US 6,964,559 B2
(45) Date of Patent: Nov. 15, 2005

(54) TWO SHAFT VACUUM PUMP WITH CANTILEVERED ROTORS

(75) Inventors: Manfred Behling, Köln (DE); Lothar Brenner, Bad Münstereifel (DE); Thomas Dreifert, Köln (DE); Hartmut Kriehn, Köln (DE); Klaus Rofall, Köln (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/257,903

(22) PCT Filed: Mar. 15, 2001

(86) PCT No.: PCT/EP01/02972

§ 371 (c)(1),
(2), (4) Date: Feb. 12, 2003

(87) PCT Pub. No.: WO01/79701

PCT Pub. Date: Oct. 25, 2001

(65) Prior Publication Data

US 2003/0152468 A1 Aug. 14, 2003

(30) Foreign Application Priority Data

Apr. 18, 2000 (DE) ..... 100 19 066

(51) Int. Cl.[7] ..... F04B 17/00; F01C 1/16
(52) U.S. Cl. ..... 417/410.4; 417/362; 418/201.1
(58) Field of Search ..... 417/410.4, 362, 417/486, 557; 418/201.1, 205, 196, 206.2

(56) References Cited

U.S. PATENT DOCUMENTS 2,446,194 A * 8/1948 Samiran ..... 418/79
2,880,676 A * 4/1959 Succop ..... 417/410.4
2,937,807 A * 5/1960 Lorenz ..... 417/247
3,651,705 A * 3/1972 Bertinetti et al. ..... 474/161

(Continued)

FOREIGN PATENT DOCUMENTS

| | | | | |
|---|---|---|---|---|
| DE | 3706588 | | 8/1988 | |
| DE | 19820523 | | 11/1999 | |
| DE | 19945871 | | 3/2001 | |
| EP | 332741 | | 9/1989 | |
| EP | 472933 | | 3/1992 | |
| JP | 63198789 | | 8/1988 | |
| JP | 02277994 | | 11/1990 | |
| JP | 11093873 | | 4/1999 | |
| JP | 11-093873 A | * | 4/1999 | ..... F04C/18/18 |
| JP | 2000097186 | | 4/2000 | |
| WO | WO 99/19630 | * | 4/1999 | ..... F04C/18/16 |
| WO | WO 01/23762 | | 4/2001 | |

*Primary Examiner*—Justine R. Yu
*Assistant Examiner*—Timothy P. Solak
(74) *Attorney, Agent, or Firm*—Fay, Sharpe, Fagan, Minnich & McKee, LLP

(57) ABSTRACT

A vacuum pump (1) comprising a pump chamber casing (5) accommodating two co-operating rotors (2, 3) which are respectively arranged on a shaft (8, 9). A bearing/gear chamber (6) is disposed adjacent to the pump chamber casing (5) in which the rotor shafts (8, 9) are cantilevered and provided with a synchronisation gear (17). A drive motor (25) whose drive shaft (28) extending parallel to the rotor shafts (8, 9) and is provided with a drive gear (35). A gear stage (37) is disposed between the drive shaft (28) and one of the rotor shafts (8, 9). In order to provide a machine of this type which can be embodied in a compact form, the drive gear (35) of the drive shaft (28) engages directly with a driven gear (36) on one of the rotor shafts (8, 9), forming the gear stage (37).

23 Claims, 3 Drawing Sheets

U.S. PATENT DOCUMENTS 3,796,526 A * 3/1974 Cawley ..... 418/97
4,420,293 A * 12/1983 Hofmann ..... 418/47
4,674,960 A * 6/1987 Rando et al. ..... 417/420
4,767,284 A 8/1988 Shiinoki et al. ..... 417/312
4,877,385 A * 10/1989 Koromilas ..... 418/197
4,943,215 A 7/1990 Berges ..... 418/9
5,011,388 A * 4/1991 Aoki et al. ..... 418/95
5,118,251 A * 6/1992 Saulgeot ..... 415/90
5,197,861 A 3/1993 Maruyama et al. ..... 417/42
5,443,644 A * 8/1995 Ozawa ..... 118/715
5,454,700 A 10/1995 Iguchi et al. ..... 418/201.1
5,549,463 A 8/1996 Ozawa ..... 418/3
6,287,088 B1 9/2001 Nishimura et al. ..... 417/297
6,544,020 B1 * 4/2003 Bahnen et al. ..... 418/88

* cited by examiner

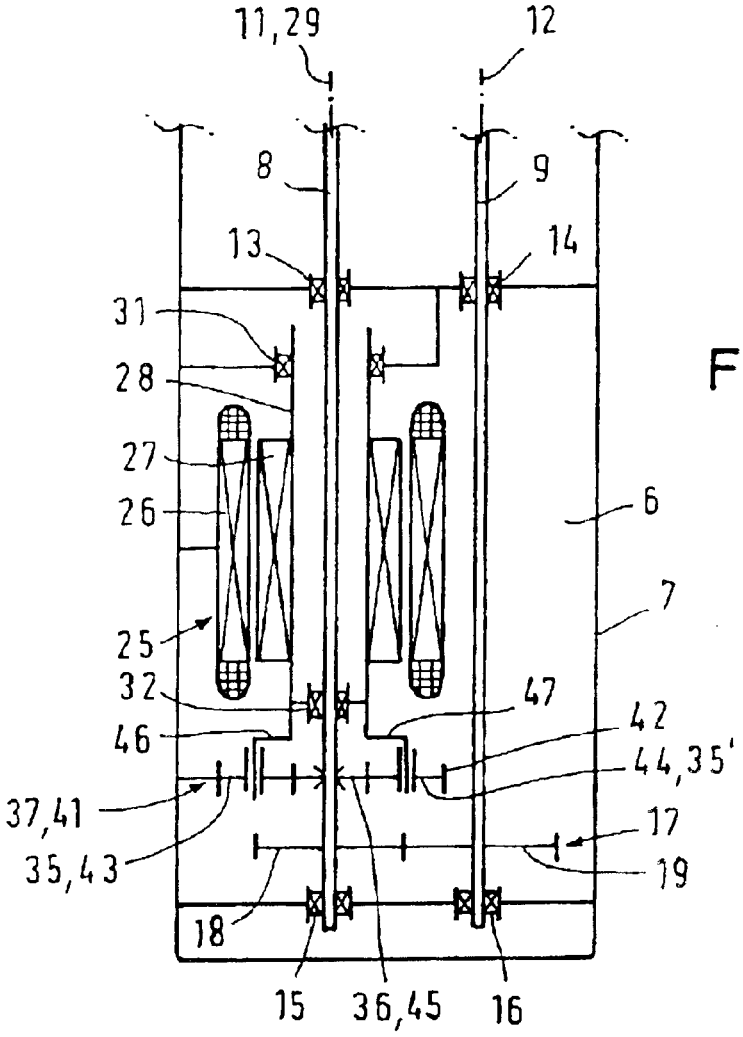
FIG. 8
FIG. 9
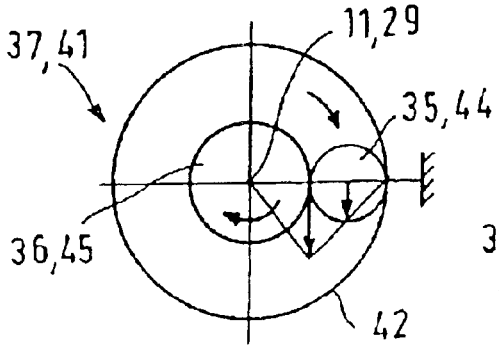
FIG. 10
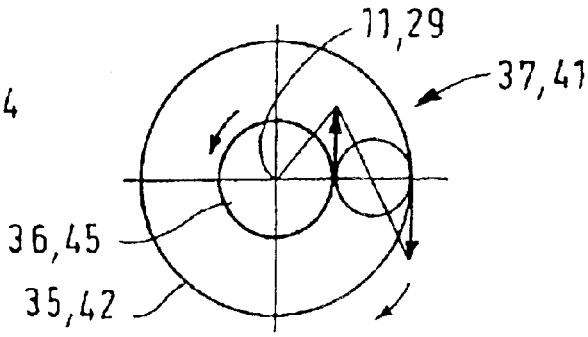

TWO SHAFT VACUUM PUMP WITH CANTILEVERED ROTORS

In U.S. Pat. No. 5,197,861, the drive motor is accommodated in a casing at the side next to the pump. In order to be able to operate the rotors at a higher speed compared to that of the motor, a gear is provided. The driving toothed gear of the motor shaft is coupled via a further toothed gear to a toothed gear arranged on one of the rotor shafts. A solution of this kind requires much space. Moreover, four shafts are present which each need to be equipped with bearings.

Vacuum pumps of this kind belong to the class of two-shaft vacuum pumps. Typical examples of two-shaft vacuum pumps are Roots pumps, claws pumps and screw pumps. The two rotors of such pumps are located in a pump chamber and effect pumping of the gases from an inlet to an outlet. The cantilevered bearing offers, in the instance of axially pumping machines, the benefit that on the suction side (high-vacuum side) shaft seals are not necessary.

In two-shaft machines with synchronised shafts, direct driving of one of the two shafts is common (c.f. DE 198 20 523 A1, for example). If in machines of this type common AC drive motors are employed, there result rotor speeds of 3000 rpm. (at 50 Hz) and 3600 rpm. (at 60 Hz) respectively. Pumps being operated at such speeds have a low power density, require narrow slots and/or many stages and are for this reason relatively large, heavy and costly. Increasing the speed would be possible with the aid of a frequency converter; however, frequency converters for large drive power ratings are expensive.

It is the task of the present invention to design a vacuum pump of the kind affected here in a more simple and more compact manner.

SUMMARY OF THE INVENTION

A primary advantage of the present invention is, that the means which are required for a transmission to the higher speed—doubling of rotor speed, for example—are much simpler compared to the state-of-the-art.

Another advantage is that commonly employed motor technology can be retained.

Other advantages reside in extremely slim and compact designs and in addition, simplified cooling of the electric motor.

Still further advantages will be apparent to those of ordinary skill in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

Further advantages and details of the present invention shall be explained with reference to examples of embodiments depicted schematically in drawing FIGS. 1 to 10. Depicted in drawing FIGS. 4 to 10 are examples of embodiments in which the motor rotor and one of the rotor shafts have a joint axis of rotation.

DETAILED DESCRIPTION OF THE PREFERRED EMBODIMENTS

Figure 1:
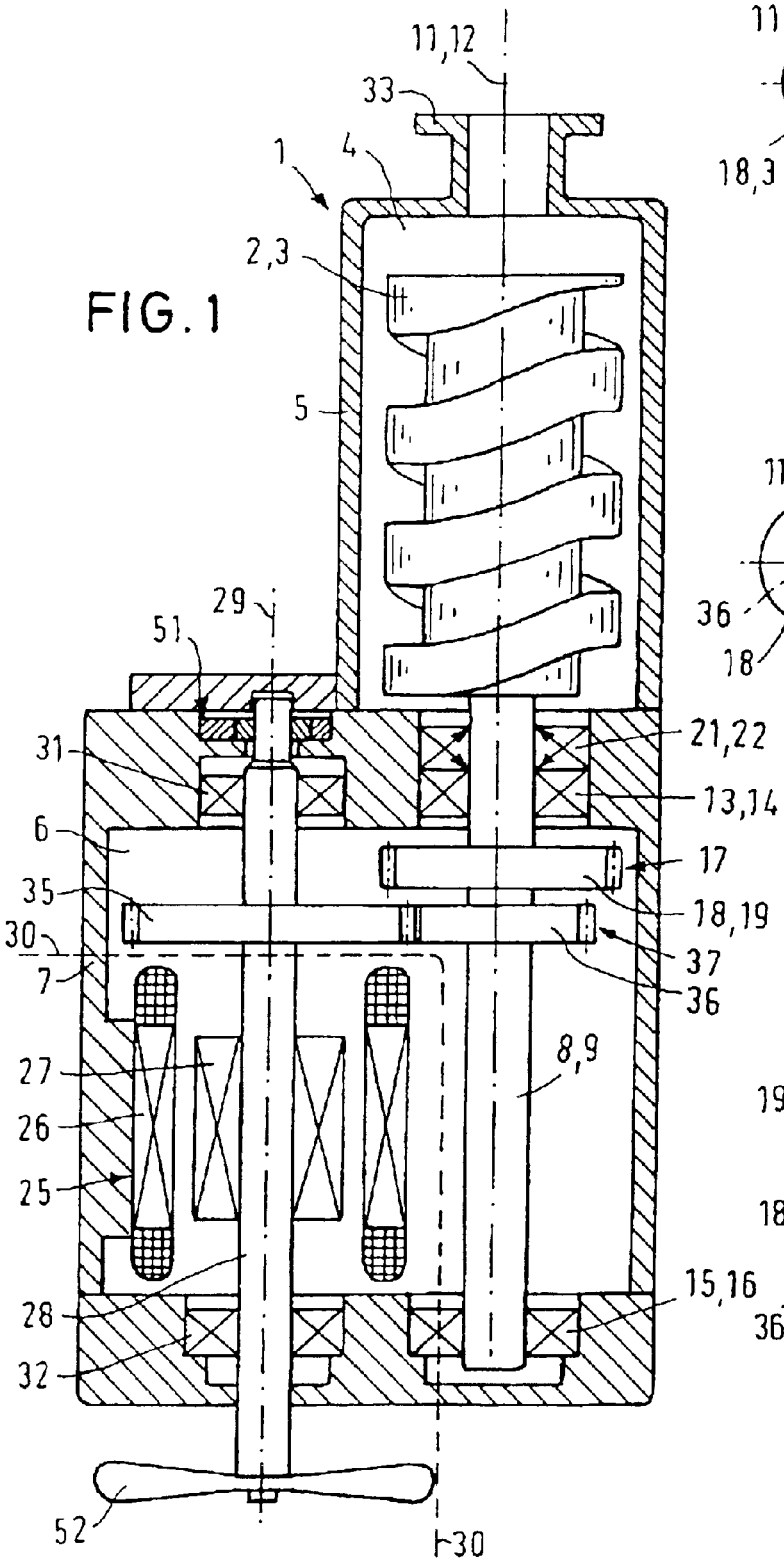
FIGS. 1 to 3 are examples of embodiments according to the present invention, in which the motor rotor runs on a separate motor shaft arranged beside the rotor shafts and drawing

In the drawing figures, the two-shaft vacuum pump is designated as 1, its rotors as 2, 3, its pump chamber as 4 and its pump chamber casing as 5. Adjoined to pump chamber casing 5 is the bearing/gear chamber 6, the casing of which is designated as 7. The rotor shafts 8, 9 extend into the bearing/gear chamber 6. The axes of rotation of the rotors and the shafts are designated as 11 and 12. The shafts are supported by bearings on the side of the pump chamber and on the side of their ends (bearings 13 to 16) so that the rotors 2, 3 are supported in a cantilevered manner. The rotor shafts 2, 3 are coupled via a synchronising gear 17 being formed by two engaging toothed gears 18, 19. Gaskets 21, 22 are provided for the purpose of sealing off the pump chamber 4 against the bearing chamber 6.

In all examples of the embodiments depicted, the drive motor 25 is located in the bearing/gear chamber 6. The stator 26 encompasses the armature 27 being affixed on to the motor shaft 28. The motor shaft 28 extends in each instance in parallel to the rotor shafts 8, 9 and is supported by bearings in the area of its ends (bearings 31, 32) in the bearing/gear chamber 6. Its axis of rotation is designated as 29.

There also exists the possibility of arranging a standard motor outside of casing 7 and to link said motor to a shaft extending within the bearing/gear chamber 6 in parallel to the rotor shafts 8,9 with the motor shaft carrying the driving toothed gear 35. This and any other toothed gears can be advantageously constructed from plastic. A solution of this kind is outlined through the dashed line 30 in drawing FIG. 1.

As an example, a screw vacuum pump 1 is depicted in drawing FIG. 1. Plane 23 (drawing FIGS. 2, 3 and 4) formed by the axes of rotation 11, 12, is perpendicular to the plane of the drawing figure, so that only one rotating unit is visible. During their operation, the rotors 2, 3 pump gases from inlet 33 to an outlet which is not depicted.

In the screw vacuum pump in accordance with drawing FIG. 1, the motor shaft 28 is adjoined at the side of the plane formed by axes of rotation 11, 12. The motor shaft carries a driving toothed gear (driving gear 35) which directly engages with a toothed gear (driven gear 36). Driving gear 35 and driven gear 36 form a gear stage 37. The driven gear 36 is affixed on to one of the rotor shafts 8, 9. Synchronous driving of the second rotor shaft is in each instance effected through the toothed gears 18, 19 of the synchronising gear 17.

Figure 2:
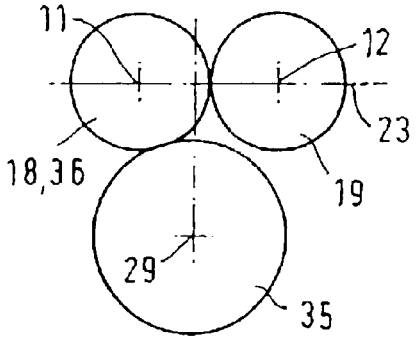
Figure 3:
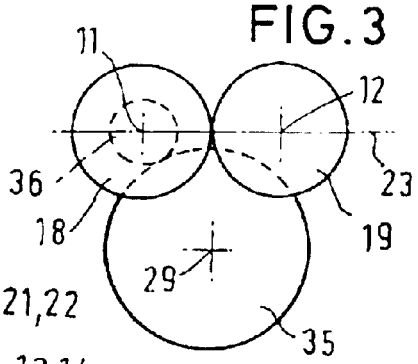
Figure 4:
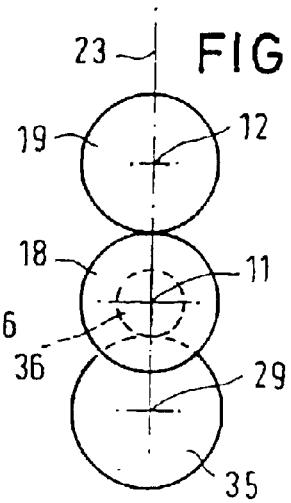
Figure 5:
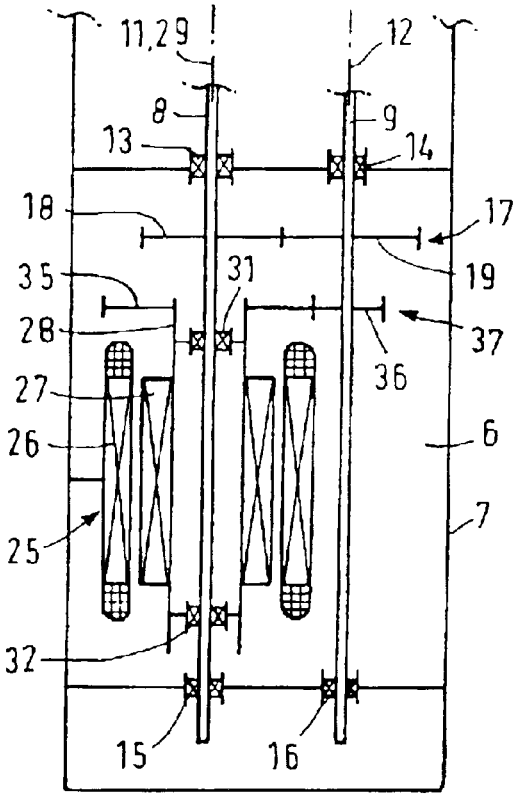
Figure 6:
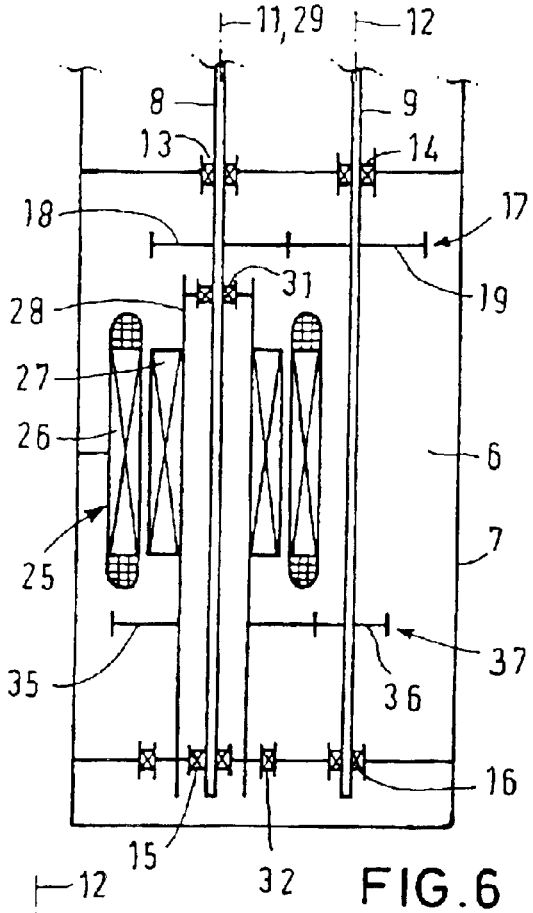

Drawing FIGS. 2 to 4 outline coupling options of the kind detailed. In the solution according to drawing FIG. 2, the driving gear 35 engages with one (18) of the two synchronising toothed gears 18, 19. The toothed gear 18 acts at the same time as the driven gear 36. The transmission ratio is determined by the ratio between the diameters of the toothed gears 35 and 18.

The embodiment in accordance with drawing FIG. 3 substantially corresponds to the solution depicted in drawing FIG. 1. Located under the synchronising toothed gear 18 on the shaft 8, there is a further, toothed gear 36 preferably smaller in diameter, which engages with the driving toothed gear 35. The same also applies to the solution in accordance with drawing FIG. 4. The difference compared to drawing FIG. 3 is that the axes of rotation 11, 12 and 29 are located in one plane.

From drawing FIGS. 2 to 4 it is apparent that on the one hand the usable space between the rotor shafts 8, 9 may be utilised in part for the motor stator 26 (drawing FIGS. 2, 3) so that compact solutions will result. On the other hand the angle between the respective axes of rotation may be selected almost free of any restrictions.

In the embodiments in accordance with drawing FIGS. 5 to 10, the motor shaft 28 is designed to be hollow, so that there then exists the possibility of letting one of the rotor shafts penetrate the hollow shaft 28 in such a manner that the axes of rotation 29 and 11 respectively 12 are identical. In embodiments of this kind the usable space between the rotor shafts 8, 9 may be utilised even better. In all, there results from this an optimally compact and slim shape.

Figure 7:
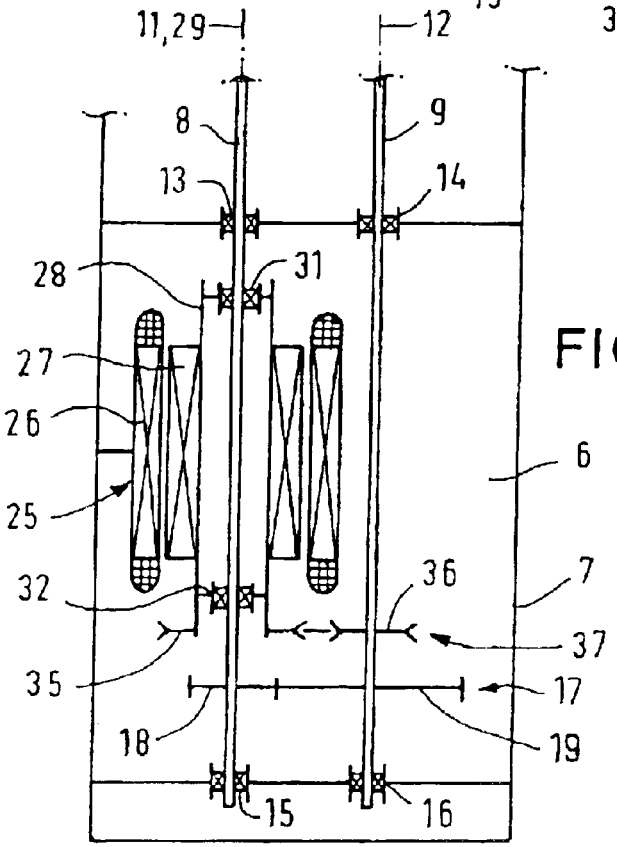

Some of the design options for such embodiments are depicted in drawing FIGS. 5 to 10. In the solutions in accordance with the drawing FIGS. 5 and 6, the hollow shaft 28 carries in each instance the driving gear 35 which engages with the driven gear 36 on the rotor shaft located besides the hollow shaft 28. The synchronisation gear 17 offset which respect to this is employed for synchronised driving the rotor shaft 8 penetrating the hollow shaft 28. Also in the drawing FIGS. 7 and 8 a driving gear 35 and a driven gear 36 form the gear stage 37. Outlined in drawing FIG. 7 is, that the gear stage is designed by way of chain or belt stages. The solution in accordance with drawing FIG. 8 is equipped with a planet gear.

The bearing arrangement for motor shaft 28 may be effected independently of the bearings 13 to 16 for rotor shafts 8, 9 by means of carriers affixed to the casing (drawing FIG. 8, upper bearing 31). An especially compact solution is attained when the motor shaft 28 is supported by at least one (drawing FIG. 8, bearing 32) preferably both bearings 31, 32 (drawing FIGS. 5 and 7) on the rotor shaft 8 penetrating the hollow shaft 28. Moreover, the rotor shaft 8 penetrating the hollow shaft 28 may be supported within the hollow shaft (bearings 15 in drawing FIG. 6). Finally there is depicted in drawing FIG. 7 as a special feature that the transmission ratio of the synchronising stage may differ from 1:1. The toothed gears 18 and 19 have differing diameters, outlining a transmission ratio of 2:1. Required for this is that the rotors 2, 3 be designed correspondingly.

Drawing FIGS. 8 to 10 depict the way in which the hollow motor shaft 28 is coupled to the rotor shaft 8 centrally penetrating the hollow shaft, said coupling being effected by a planet gear 41, forming the gear stage 37. The planet gear comprises in a manner which is basically known the outer ring gear 42, for example two planet gears 43, 44 as well as the sun gear 45 affixed to the rotor shaft 8 with axis of rotation 29. Schematic diagram 9 depicts the solution presented in drawing FIG. 8 with a fixed ring gear 42. The plant gears 43, 44 which are joined via cranks 46, 47 to the motor shaft 28, form the driving gears 35, 35'. Only one planet gear 44 would suffice as the driving gear 35 (drawing FIG. 9). The sun gear 45 forms the driven gear 36.

In the solution in accordance with drawing FIG. 10 the ring gear 42 forms the driving gear 35. For the planet gear 44 a fixed carrier is provided. The sun gear 45 again forms the driven gear 36. Although in the instance of this solution the driving gear 35 and the driven gear 36 no not engage directly, the aims of the invention—compact, simple—can be attained.

It has already been proposed to equip at least one of the rotor shafts 8, 9 with a central bore and to utilise said bore(s) for conveying a lubricating and cooling agent (preferably oil). Where the drive motor 25 is arranged within the bearing/gear chamber, said motor may also be cooled with the oil. An oil pump for pumping the oil may be arranged on one of the shafts 8, 9 or 28. If the motor shaft 28 should be located besides the rotor shafts 8, 9 then a particularly expedient solution is such that the oil pump—preferably designed as an eccentric pump—be arranged on the motor shaft 28, specifically in the area of its upper end. This embodiment is depicted in drawing FIG. 1. The oil pump is designated as 51. In addition, one of the shafts 8, 9 or 28 may be run out, on its side adjacent to the pump chamber, from the bearing/gear chamber 6 in a sealed manner and carry a ventilating wheel 52. Expediently, to this end also the motor shaft 28 is utilised in accordance with drawing FIG. 1.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An axially pumping vacuum pump comprising:

a pump chamber casing defining a pump chamber having a suction side, the pump chamber accomodating first and second co-operating rotors which are arranged on first and second parallel rotor shafts;

a bearing/gear chamber having a first wall adjacent to the pump chamber and a second wall opposite to the first wall away from the pump chamber, the rotor shafts being cantilevered into the pump chamber and being supported by first bearings located in the first wall between the pump chamber and the bearing/gear chamber and second bearings located in the second wall, the bearings being located remote from the suction side;

a drive motor accomodated within the bearing/gear chamber, the drive motor including a stator and an armature mounted to a motor drive shaft, the motor drive shaft extending, parallel to the rotor shafts, the motor drive shaft being supported in bearing located in the first and second walls with the armature between the bearings, a toothed drive gear, the drive gear engaging at least one toothed driven gear, the driven gear being one of attached to one of the rotor shafts, and a synchronization gear within the bearing/gear chamber that synchronizes rotation of the rotor shafts, the driven gear having a smaller diameter than the drive gear.

2. The vacuum pump according to claim 1, wherein a transmission ratio between the drive gear and the synchronizing gear differs from 1:1.

3. The vacuum pump according to claim 1, further including one of a chain drive and belt drive.

4. The vacuum pump according to claim 1, wherein a transmission ratio between the drive geara and the driven gear is other than 1:1.

5. The vacuum pump according to claim 1, wherein the at least one of the drive, driven, and synchronization gears are toothed and made of plastic.

6. The vacuum pump according to claim 1, further including:

gaskets in the first wall that seal off the pump chamber against the bearing/gear chamber, the gaskets being located remote from the suction side.

7. The vacuum pump according to claim 1, further including:

gaskets situated at the first wall between the pump chamber and the bearings to seal the pump chamber from both the bearing/gear chamber and the bearings.

8. The vacuum pump according to claim 1, wherein the synchronization gear includes:

a first toothed wheel mounted to the first rotor shaft; and a second toothed wheel mounted to the second rotor shaft, the first and second toothed wheels being the same.

9. The vacuum pump according to claim 1, wherein the driven gear and the synchronization gear include toothed wheels of the same size, the driven toothed wheel being connected to the first rotor shaft and engaging the drive gear and the synchronization toothed wheel being mounted to the second shaft and engaging the driven toothed wheel.

10. A vacuum pump comprising:

a pump chamber casing accommodating two co-operating rotors which are respectively arranged on parallel rotor shafts;

a bearing/gear chamber adjacent to the pump chamber casing, in which the rotor shafts are cantilevered and provided with a synchronization gear;

a drive motor accomodated within the bearing/gear chamber whose drive shaft extends parallel to the rotor shafts and is provided with a drive gear, the drive shaft being supported in the bearing/gear chamber via bearings, at least one of the bearings of the motor shaft being supported on the rotor shaft, the drive gear of the drive shaft engaging directly with a driven gear, forming a gear stage.

11. The vacuum pump according to claim 10, wherein the drive gear of the drive shaft engages the synchronization gear which has a smaller diameter than the driving gear.

12. The vacuum pump according to claim 10, wherein the drive gear of the drive shaft engages with the driven gear on one of the rotor shafts, said driven gear having a smaller diameter than the synchronizing toothed gear on the drive shaft, the drive, synchronizing and driven gears being toothed.

13. The vacuum pump according to claim 10, wherein the drive shaft is locaed beside the rotor shafts.

14. The vacuum pump according to claim 13, wherein at one end of the motor shaft an oil pump is located.

15. The vacuum pump according to claim 13, wherein the motor shaft is run out of the gear/bearing chamber and carries a ventilating wheel opposite the pump chamber.

16. The vacuum pump according to claim 10, wherein the gear stage includes a planet gear with a fixed ring gear.

17. The vacuum pump according to claim 16, wherein the gears are toothed and made of plastic for the purpose of reducing noise.

18. The vacuum pump according to claim 10, wherein the gear stage includes one of a chain and a belt.

19. The vaccum pump according to claim 10, wherein the drive shaft is hollow and one of the rotor shafts is encased in the drive shaft.

20. The vaccum pump according to claim 10, further including: gaskets that seal off the pump chamber from the bearing chamber.

21. The vacuum pump according to claim 20 wherein the pump chamber casing defines a pump chamber which accomodates the cooperating rotors, the pump chamber having a suction side, the gaskets being remote from the suction side.

22. A vacuum pump comprising:

a pump chamber casing accomodating two co-operating rotor which are respectively arranged on parallel shafts;

a bearing/gear chamber adjacent to the pump chamber casing in which the rotor shafts are cantilevered and provided with a synchronization gear;

a drive motor accomodated within the bearing gear/chamber whose drive shaft is hollow and extends parallel to the rotor shafts and is provided with a drive gear; one of the rotor shaftes being encased within the hollow drive shaft and is supported by at least one bearing in the hollow drive shaft;

a gear stage connecting the drive gear of the drive shaft with the synchronization gear and driven gear on the rotor shafts.

23. A vacuum pump comprising:

a pump chamber casing drfining a pump chamber therein;

a bearing/gear chamber casing mounted with the pump chamber casing and defining a bear/gear chamber therein;

a pair of parallel rotor shafts extending between the bearing/gear chamber and the pump chamber;

a pair of co-operating rotors mounted on the rotor shafts in the pump chamber;

a synchronization gear assembly mounted to the rotor shafts and disposed in the bearing/chamber to synchronize rotation of the rotor shafts and the cooperating rotos;

a driven gear mounted to one of the rotor shafts and disposed in the bearing/gear chamber;

a drive motor mounted in the bearing/gear chamber with a drive shaft that includes a hollow cylinder with an axial passage therethrough, one of the rotor shafts being cocnentric with extending through the hollow cylinder;

bearing disposed between the hollow cylinder and the rotor shaft extending therethrough such that the drive shaft and the rotor extending therethrough rotate independently; and a drive gear mounted to the drive shaft for driving the driven gear mounted to the one of the motor shafts.

* * * * *